US010804639B2

(12) United States Patent
Masuda et al.

(10) Patent No.: US 10,804,639 B2
(45) Date of Patent: Oct. 13, 2020

(54) CONNECTOR WITH REINFORCING RIB

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Takeshi Masuda, Mie (JP); Hiromu Ootani, Mie (JP); Takehide Teresawa, Mie (JP); Youjirou Hashimoto, Mie (JP); Kazuo Nakai, Mie (JP)

(73) Assignees: AutoNetwork Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 0 days.

(21) Appl. No.: 16/469,180

(22) PCT Filed: Nov. 22, 2017

(86) PCT No.: PCT/JP2017/041934
§ 371 (c)(1),
(2) Date: Jun. 13, 2019

(87) PCT Pub. No.: WO2018/110228
PCT Pub. Date: Jun. 21, 2018

(65) Prior Publication Data

US 2020/0099160 A1 Mar. 26, 2020

(30) Foreign Application Priority Data

Dec. 13, 2016 (JP) ..... 2016-241099

(51) Int. Cl.
*H01R 13/52* (2006.01)
*H01R 13/502* (2006.01)
(Continued)

(52) U.S. Cl.
CPC ..... *H01R 13/502* (2013.01); *H01R 13/42* (2013.01); *H01R 13/5221* (2013.01); *H01R 13/6272* (2013.01); *H01R 2201/26* (2013.01)

(58) Field of Classification Search
CPC ..... H01R 13/5202; H01R 13/5221; H01R 13/5205; H01R 13/5219; H01R 33/965
(Continued)

(56) References Cited

U.S. PATENT DOCUMENTS 8,545,275 B2 * 10/2013 Wang ..... H01R 13/44 439/680
9,071,021 B2 * 6/2015 Hiramatsu ..... H01R 13/64
2009/0111312 A1 4/2009 Nakata et al.

FOREIGN PATENT DOCUMENTS

JP 3322141 9/2002
JP 2008-166046 7/2008
(Continued)

OTHER PUBLICATIONS

International Search Report dated Dec. 26, 2017.

*Primary Examiner* — Phuong K Dinh
(74) *Attorney, Agent, or Firm* — Gerald E. Hespos; Michael J. Porco; Matthew T. Hespos

(57) ABSTRACT

A connector 20 to be fit into an open receptacle 13 of a male connector 10 includes a terminal 25 connected to an end part of a wire 22, and a housing 40 for holding the terminal 25. The housing 40 includes a lead-out portion 54 for leading out the wire 22 connected to the terminal 25 to outside, a protruding portion 46 protruding outward to face a tip part of the receptacle 13, an external fitting portion 50 projecting
(Continued)

from the protruding portion 46 toward the receptacle 13 to be externally fit to the tip part of the receptacle 13 and expose an outer surface of a base end side of the receptacle 13, and a reinforcing rib 60A, 60B connected to the lead-out portion 54 and the protruding portion 46.

6 Claims, 15 Drawing Sheets

(51) Int. Cl.
*H01R 13/42* (2006.01)
*H01R 13/627* (2006.01)

(58) Field of Classification Search
USPC ..... 439/271, 358, 385
See application file for complete search history.

(56) References Cited

FOREIGN PATENT DOCUMENTS

| | | |
|---|---|---|
| JP | 4962787 | 6/2012 |
| JP | 2013-004376 | 1/2013 |
| JP | 2014-139873 | 7/2014 |

* cited by examiner

CONNECTOR WITH REINFORCING RIB

BACKGROUND

Field of the Invention

A connector is disclosed in this specification.

Related Art

Japanese Unexamined Patent Publication No. 2008-166046 discloses a connector that includes a female housing and a male housing to be connected to each other. A backlash preventing rib is provided on one of an outer peripheral surface of a terminal accommodating portion for accommodating a female terminal in the female housing and an inner peripheral surface of a small receptacle open forward in the male housing. The vibration preventing rib is squeezed between mating peripheral surfaces to suppress vibration between the housings and to suppress terminal wear.

Dimensional accuracy of the backlash preventing rib and the mating peripheral surface needs to be enhanced and creates a problem of increasing manufacturing cost.

This specification was completed on the basis of the above situation and aims to provide a connector capable of suppressing troubles caused by vibration while reducing manufacturing cost.

SUMMARY

A connector disclosed in this specification is to be fit into an open receptacle of a mating connector, and includes a terminal connected to an end part of a wire, and a housing for holding the terminal. The housing includes a lead-out portion for leading out the wire connected to the terminal to the outside. A protruding portion protrudes out to face a tip of the receptacle. An external fitting portion projects from the protruding portion toward the receptacle to be fit externally to the tip of the receptacle and to expose an outer surface of a base end side of the receptacle. A reinforcing rib is connected to the lead-out portion and the protruding portion.

According to this configuration, the external fitting portion of the housing is fit externally to the tip of the receptacle and exposes the outer surface of the base end side of the receptacle. Thus, the connector can be reduced in weight as compared to a configuration in which the external fitting portion also is fit externally to the outer surface of the base end of the receptacle. A resonant frequency changes and the influence of the resonance of the connector can be suppressed if the connector is reduced in weight. Thus, troubles caused by vibration can be suppressed while manufacturing cost is reduced.

If the connector is reduced in weight, the rigidity of the housing is reduced and a displacement amount of the connector caused by the vibration of the wire increases. Thus, troubles such as sliding wear in parts of terminals in contact with each other due to positional deviations of the terminals and the like may easily occur. However, in the above configuration, the protruding portion and the lead-out portion are connected by the reinforcing rib. Thus, the rigidity of the housing is enhanced by the reinforcing rib and the displacement of the connector can be suppressed. In this way, troubles due to a reduction in the rigidity of the housing and an increase in the displacement amount of the connector can be suppressed.

A plurality of the terminals connected to a plurality of the wires may be provided. The lead-out portion leads out the wires, and the reinforcing rib extends in a direction intersecting an arrangement direction of the wires.

If the wires vibrate, the lead-out portion is vibrated more easily in the direction intersecting the arrangement direction of the wires than the arrangement direction of the wires. The reinforcing rib suppresses troubles caused by vibration in a direction to easily cause vibration.

The protruding portion includes a thick portion having an increased thickness, and the reinforcing rib is connected to the thick portion. Thus, the strength of a connecting part of the protruding portion and the reinforcing rib can be enhanced by the thick portion. Thus, troubles caused by the deformation of the housing can be suppressed.

The protruding portion and the external fitting extend along an outer periphery of the receptacle.

According to this specification, it is possible to suppress troubles caused by vibration while reducing manufacturing cost.

DETAILED DESCRIPTION

An embodiment is described with reference to FIGS. 1 to 15.

Figure 1:
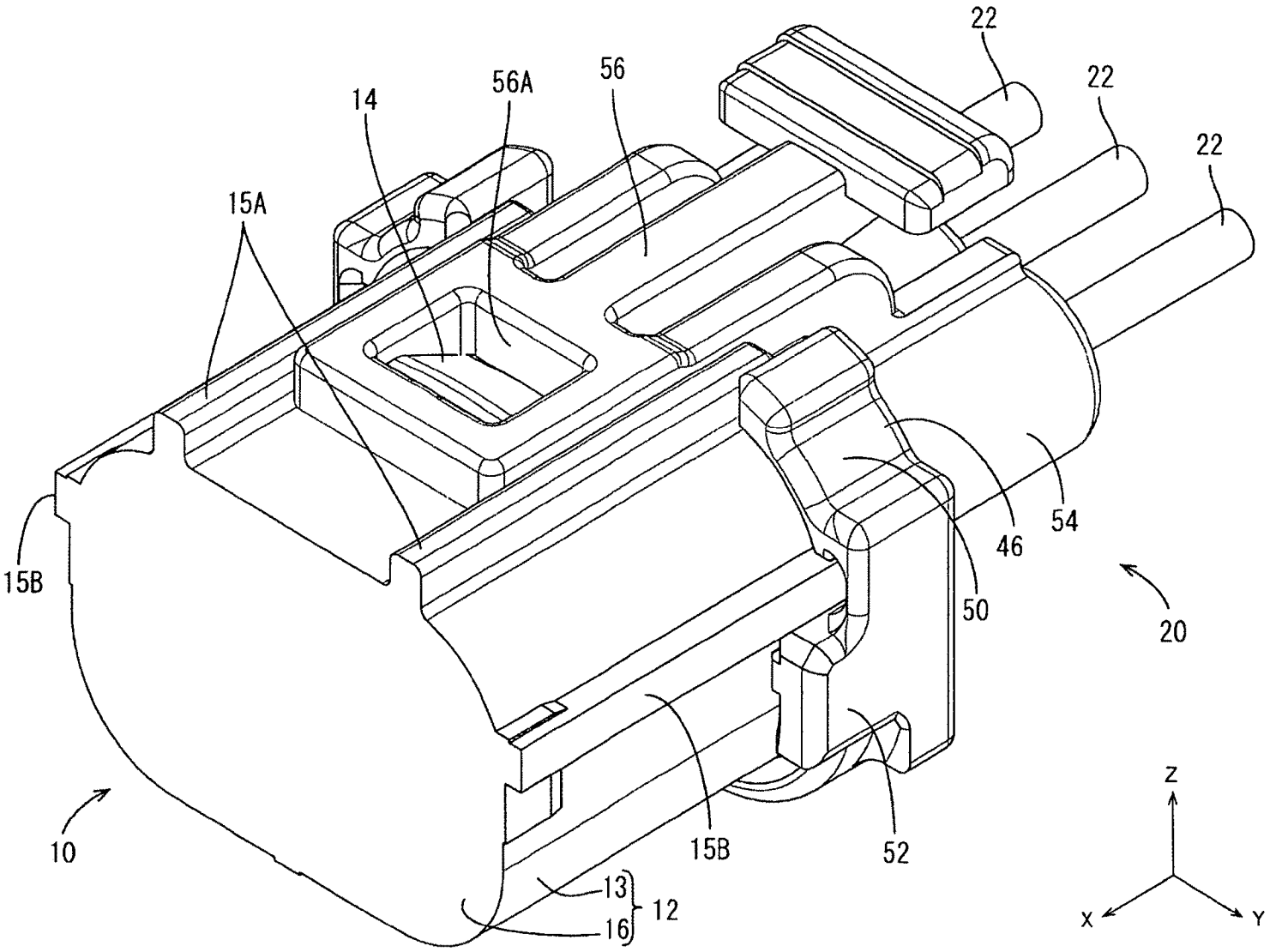
FIG. 1 is a perspective view showing a state where a connector of an embodiment is connected to a mating male connector.

A connector 20 of this embodiment is a female connector to be connected to a mating male connector 10 and, for example, is arranged in a power supply path of a vehicle, such as an automotive vehicle. In the following description, an X direction, a Y direction and a Z direction of FIG. 1 are referred to as a forward direction, a leftward direction and an upward direction.

(Male Connector 10)

Figure 2:
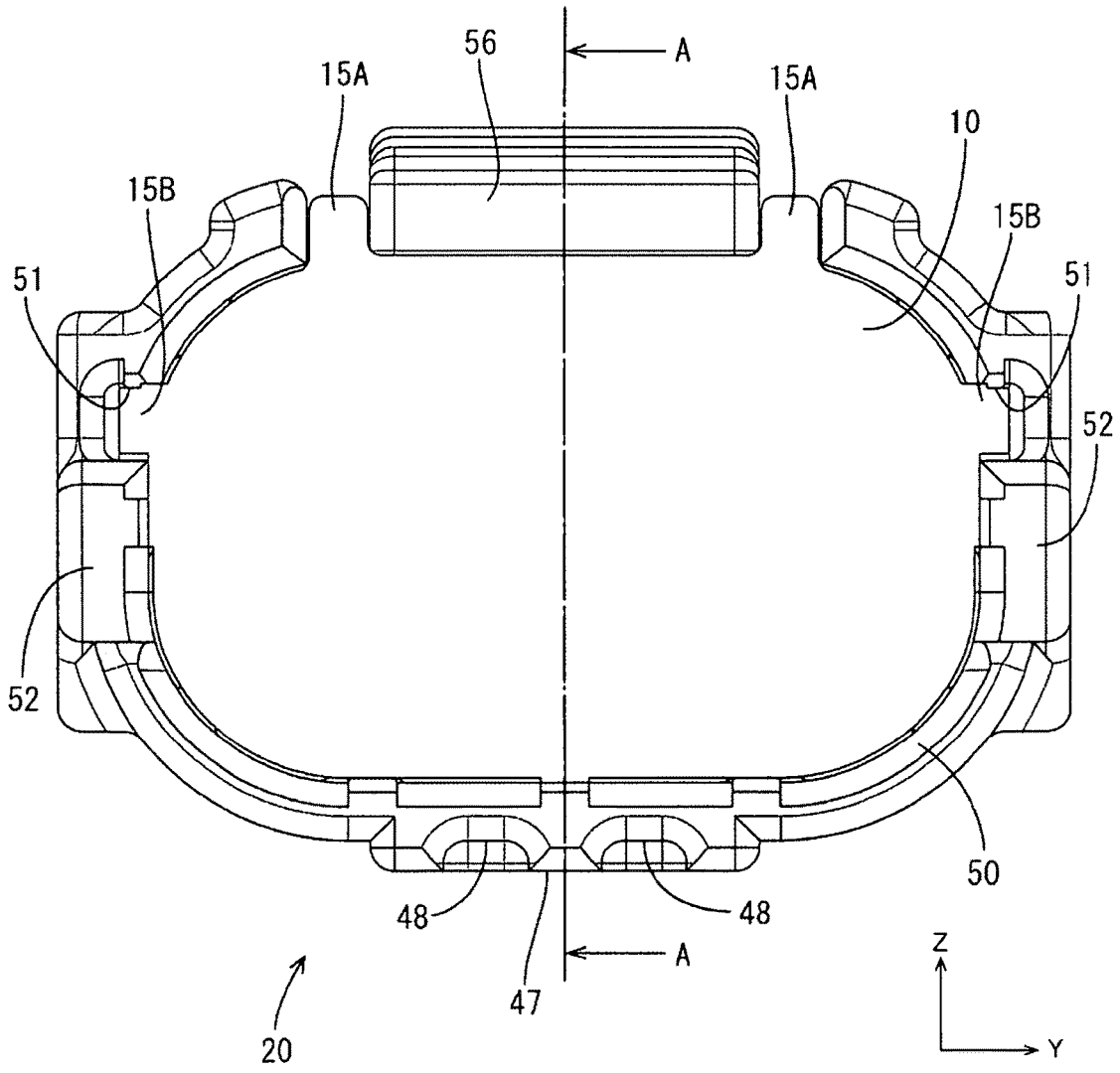
FIG. 2 is a front view showing the state where the connector is connected to the mating male connector.
Figure 3:
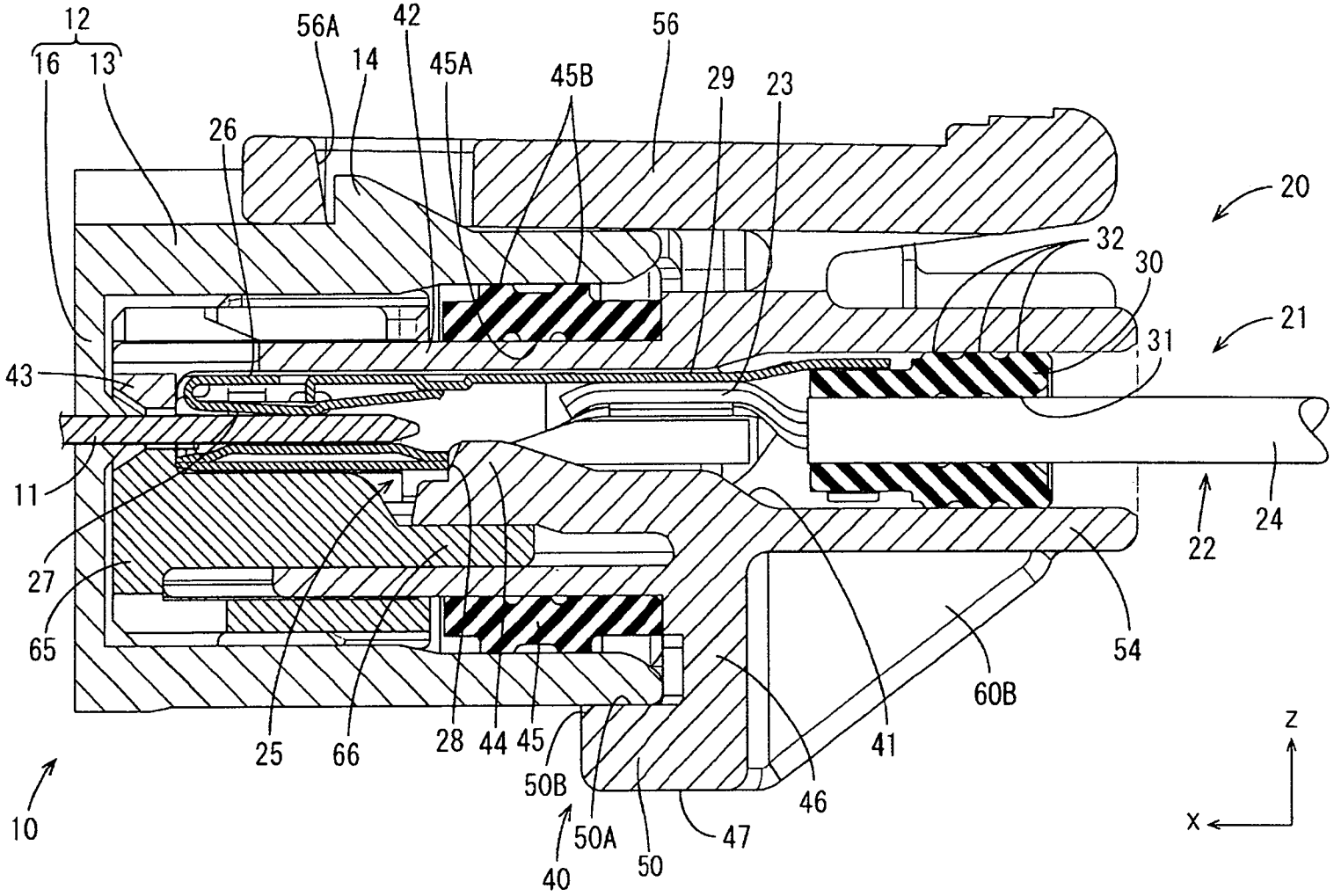
FIG. 3 is a section along A-A of FIG. 2.

As shown in FIG. 3, the male connector 10 includes male terminals 11 (front ends of the male terminals 11 are not shown in FIGS. 1 to 3) and a male housing 12 made of insulating synthetic resin for holding the male terminals 11. The male housing 12 includes an open receptacle 13 and a back wall 16 closing the receptacle 13. The male terminals 11 penetrate through the back wall 16 to project into the receptacle 13, and the unillustrated front ends may be bent into an L shape.

The receptacle 13 is an elliptical tube long in a lateral direction and a lock protrusion 14 projects up in a stepped manner on the top of the outer surface of the receptacle 13. As shown in FIG. 1, ridges 15A, 15B project out on the outer periphery of the receptacle 13 and extend in a front-rear direction (connecting direction). The ridges 15A, 15B include laterally spaced left and right ridges 15A on the top of the receptacle 13 and left and right ridges 15B provided respectively on the side surfaces of the receptacle 13.

(Connector 20)

Figure 7:
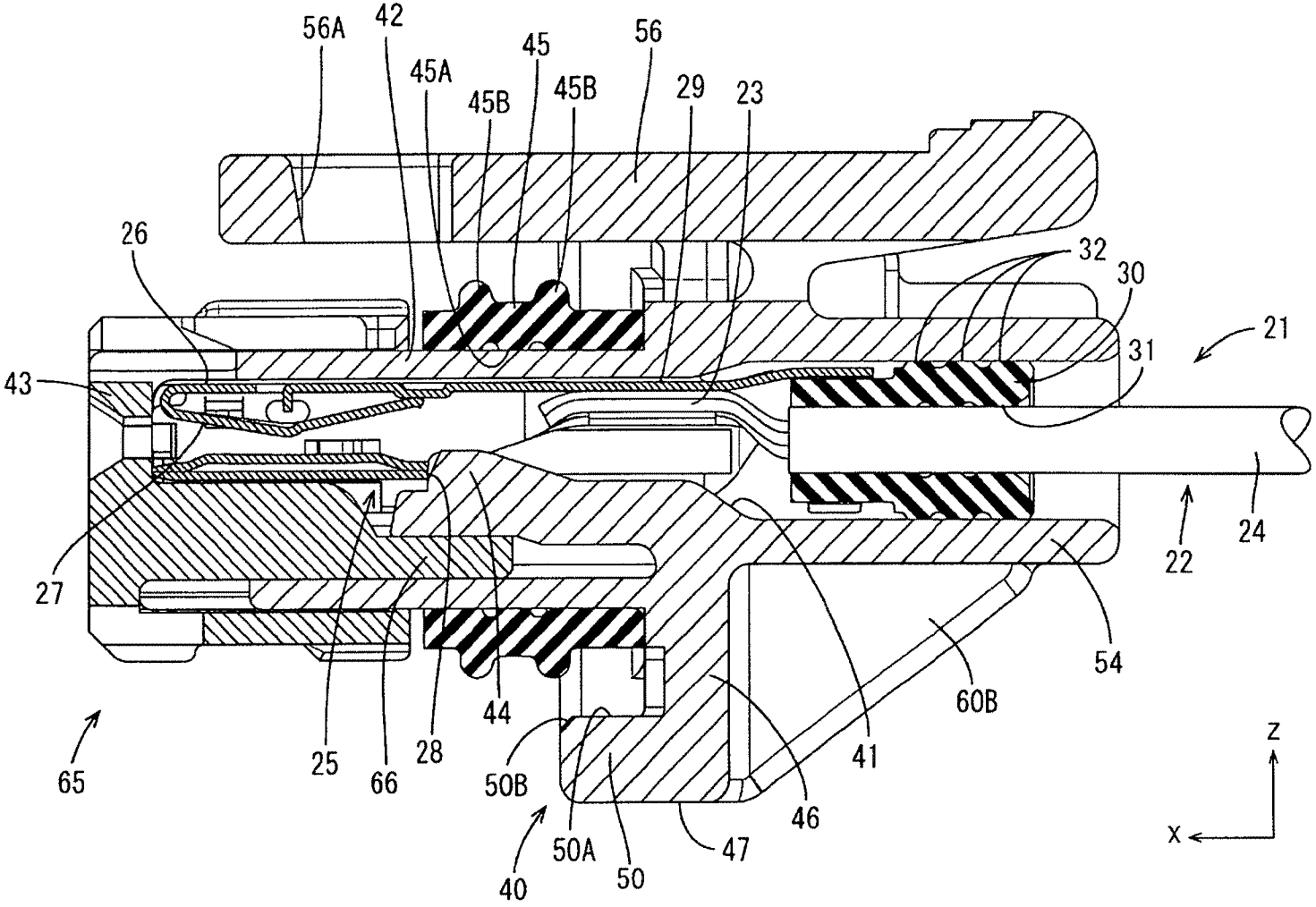
FIG. 7 is a section along B-B of FIG. 6.
Figure 8:
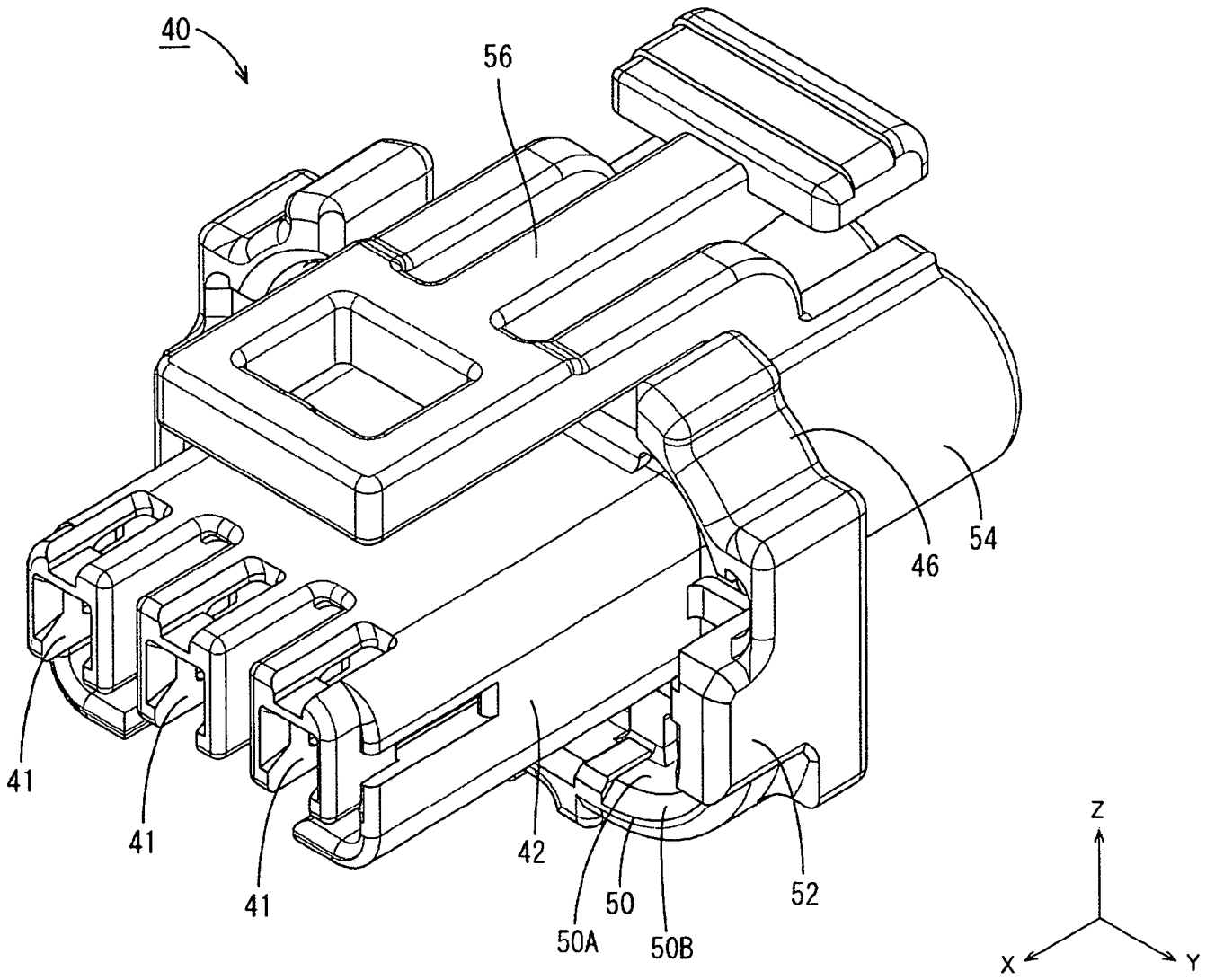
FIG. 8 is a perspective view showing a housing.
Figure 9:
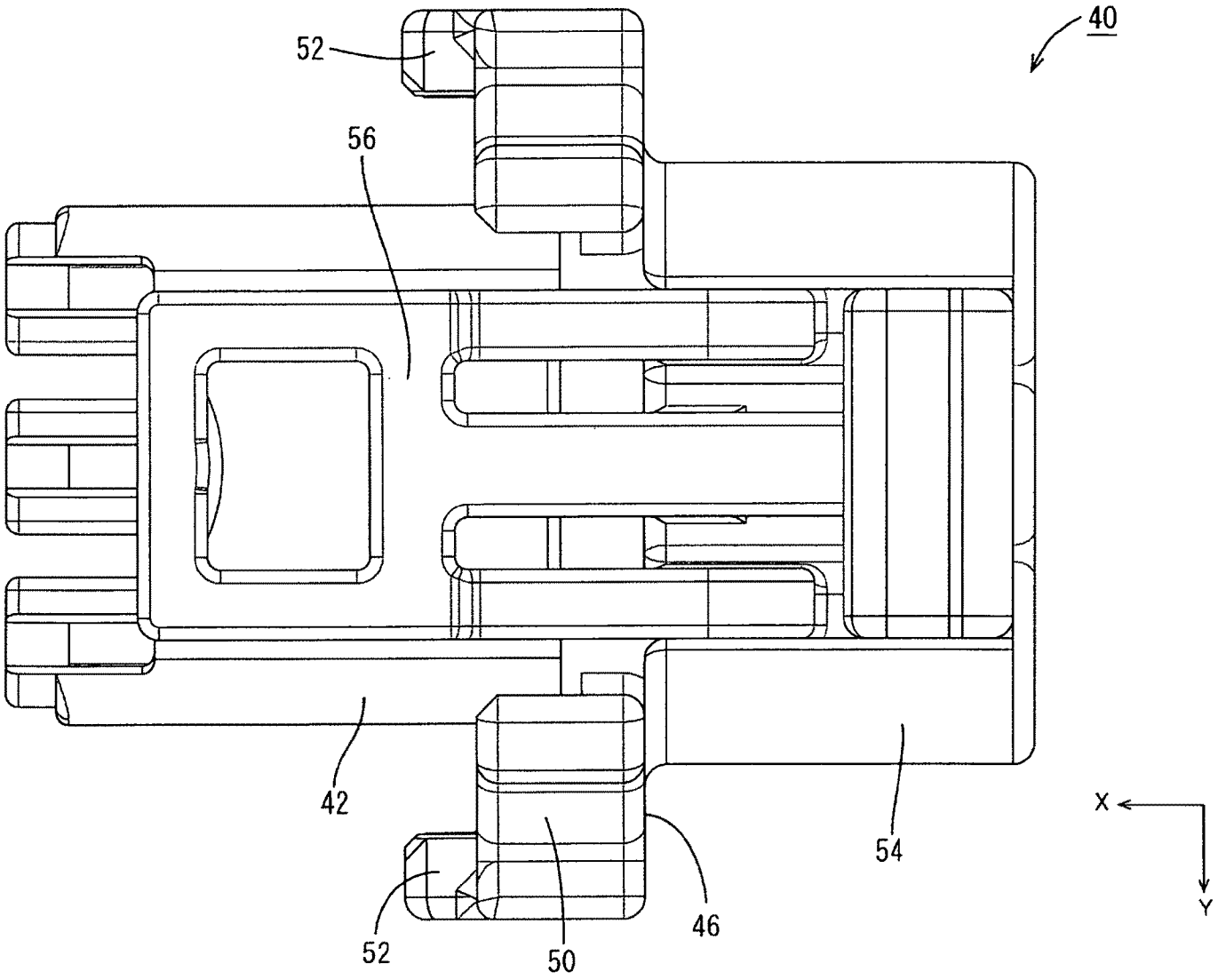
FIG. 9 is a plan view showing the housing.

As shown in FIG. 7, the connector 20 includes terminal-provided wires 21, a housing 40 made of insulating synthetic resin for holding terminals 25 and a retainer 65 to be mounted into a front part of the housing 40.

(Terminal-Provided Wire 21)

The terminal-provided wire 21 has the terminal 25 is connected to an end part of a wire 22. The wire 22 has a conductor 23 covered around by an insulation coating 24. The conductor 23 is, for example, a twisted wire formed by twisting a multitude of metal strands.

The terminal 25 includes a terminal connecting portion 26 to be connected to the male terminal 11 and a wire connecting portion 29 to be connected to the wire 22. The terminal connecting portion 26 has a box shape and includes a resilient contact piece 27 folded inward from a tip part. The resilient contact piece 27 resiliently contacts the male terminal 11 inserted into the terminal connecting portion 26. A rear part of the terminal connecting portion 26 has a cutout 28 that is locked to a locking lance 44 of the housing 40, thereby retaining the terminal 25 against a force acting in a direction to withdraw the terminal 25. The wire connecting portion 29 is crimped to the conductor 23 exposed on the end part of the wire 22.

A tubular rubber plug 30 is mounted on the wire 22. The rubber plug 30 is held in close contact with the insulation coating 24 of the wire 22 and is formed with a wire insertion hole 31 penetrating in the front-rear direction. The wire 22 is inserted through the wire insertion hole 31. Wavy lips 32 are formed side by side in the front-rear direction on the outer periphery of the rubber plug 30 and extend in a circumferential direction. A clearance between the wire 22 and an insertion hole 41 of the housing 40 is sealed by this rubber plug 30 to suppress the intrusion of water and the like toward the terminal 25 through the opening of the insertion hole 41 of the housing 40.

(Housing 40)

The insertion holes 41 penetrate the housing 40 in the front-rear direction, and the terminal-provided wires 21 are inserted into the insertion holes 41 while being arranged side by side in the lateral direction. The housing 40 includes an accommodating portion 42 for accommodating the terminals 25, a protruding portion 46 protrud out from the accommodating portion 42, an external fitting 50 projecting from the protruding portion 46 toward the receptacle 13 to be fit externally to a tip of the receptacle 13, a lead-out portion 54 disposed behind the accommodating portion 42 for leading out the wires 22, and reinforcing ribs 60A, 60B connected to the protruding portion 46 and the lead-out portion 54.

The accommodating portion 42 has a rectangular parallelepiped shape. A front end part of the accommodating portion 42 is cut so that the male terminals 11 are insertable therein and is formed with a front stop 43 for restricting forward movements of the terminals 25. The cantilevered locking lance 44 extends forward from the wall of the insertion hole 41. The locking lance 44 is deflectable and deformable and retains the terminal 25 by being locked to the cutout 28 of the terminal 25. The protruding portion 46 protrudes out on a base end part of the accommodating portion 42. A seal ring 45 is mounted on the outer periphery of the accommodating portion 42. The seal ring 45 is formed of a resiliently deformable material, such as rubber. Wavy lips 45A, 45B extend circumferentially on inner and outer peripheries of the seal ring 45 and are arranged side by side in the front-rear direction. The outer surface of the seal ring 45 is held in close contact with the inner surface of the receptacle 13 when the housings 12, 40 are connected.

Figure 10:
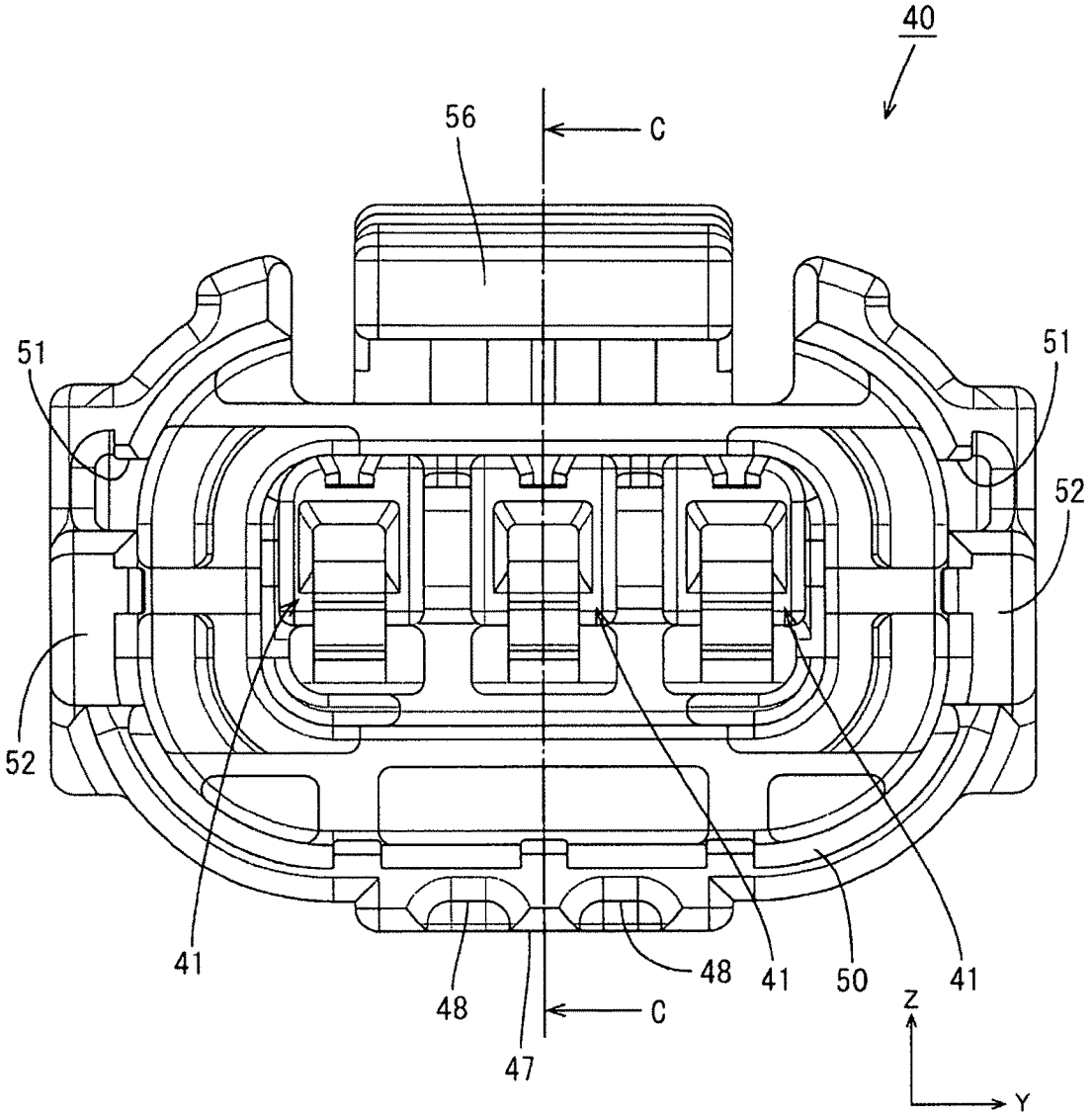
FIG. 10 is a front view showing the housing.
Figure 11:
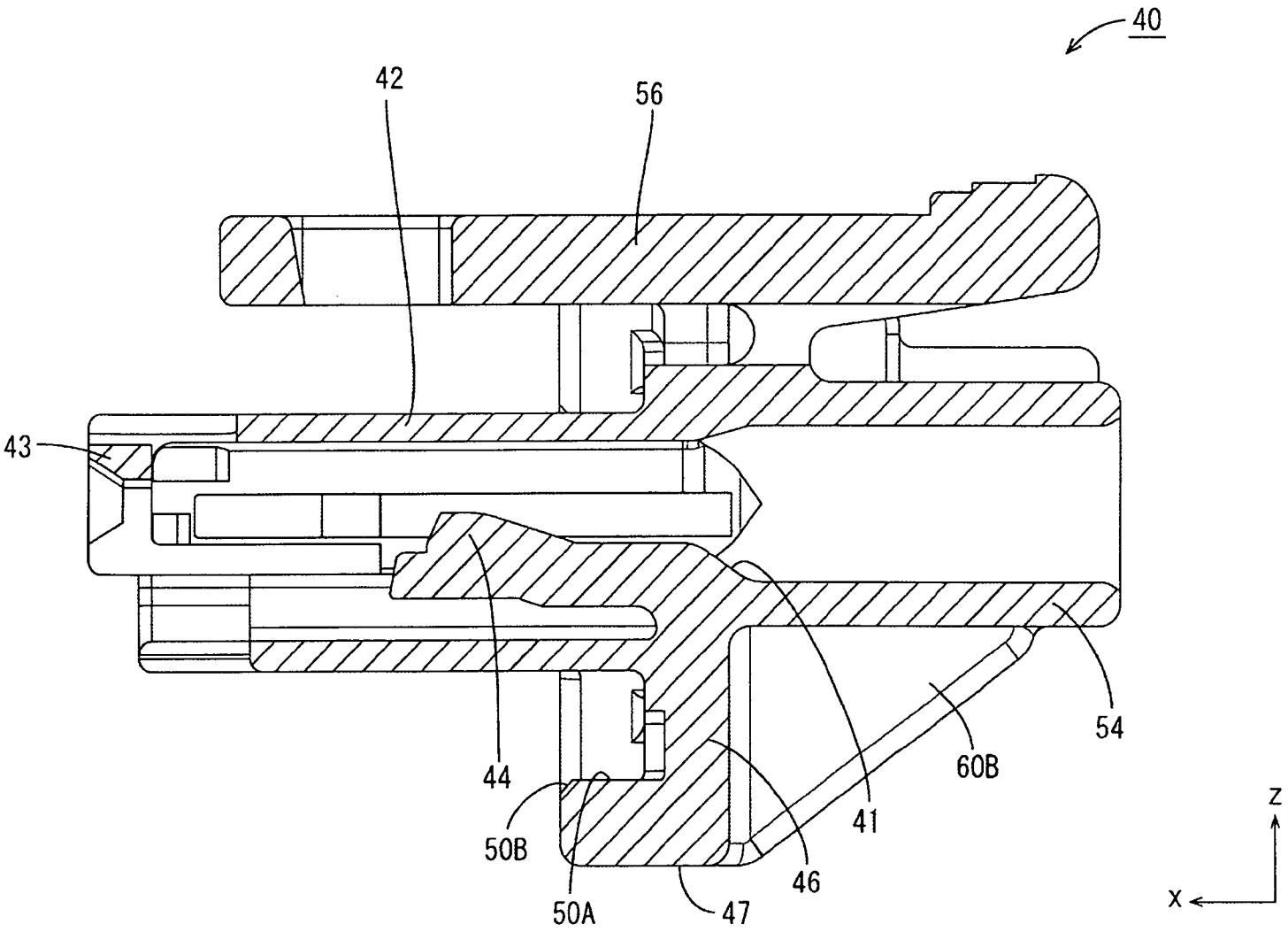
FIG. 11 is a section along C-C of FIG. 10.
Figure 12:
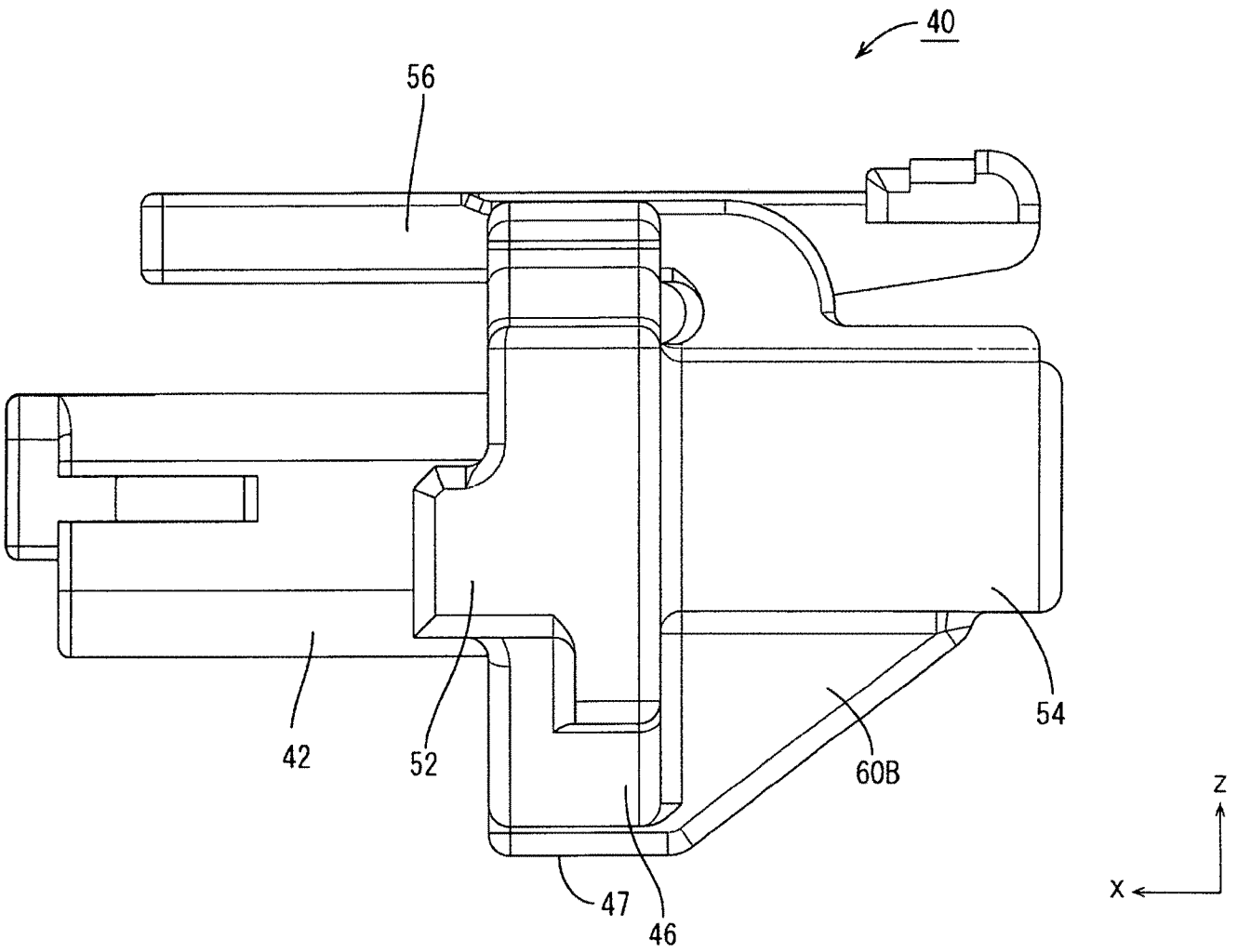
FIG. 12 is a side view showing the housing.
Figure 13:
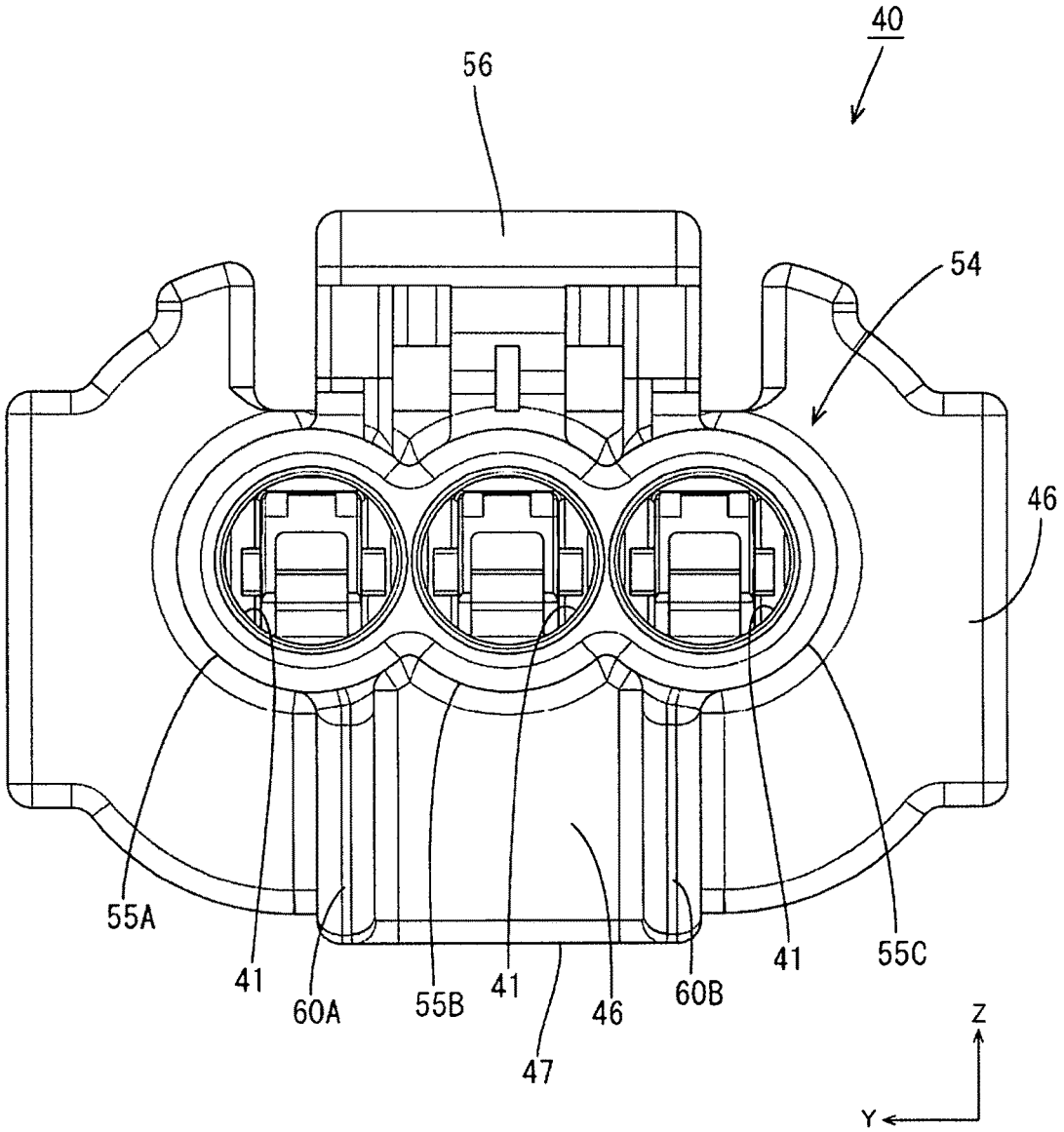
FIG. 13 is a back view showing the housing.
Figure 14:
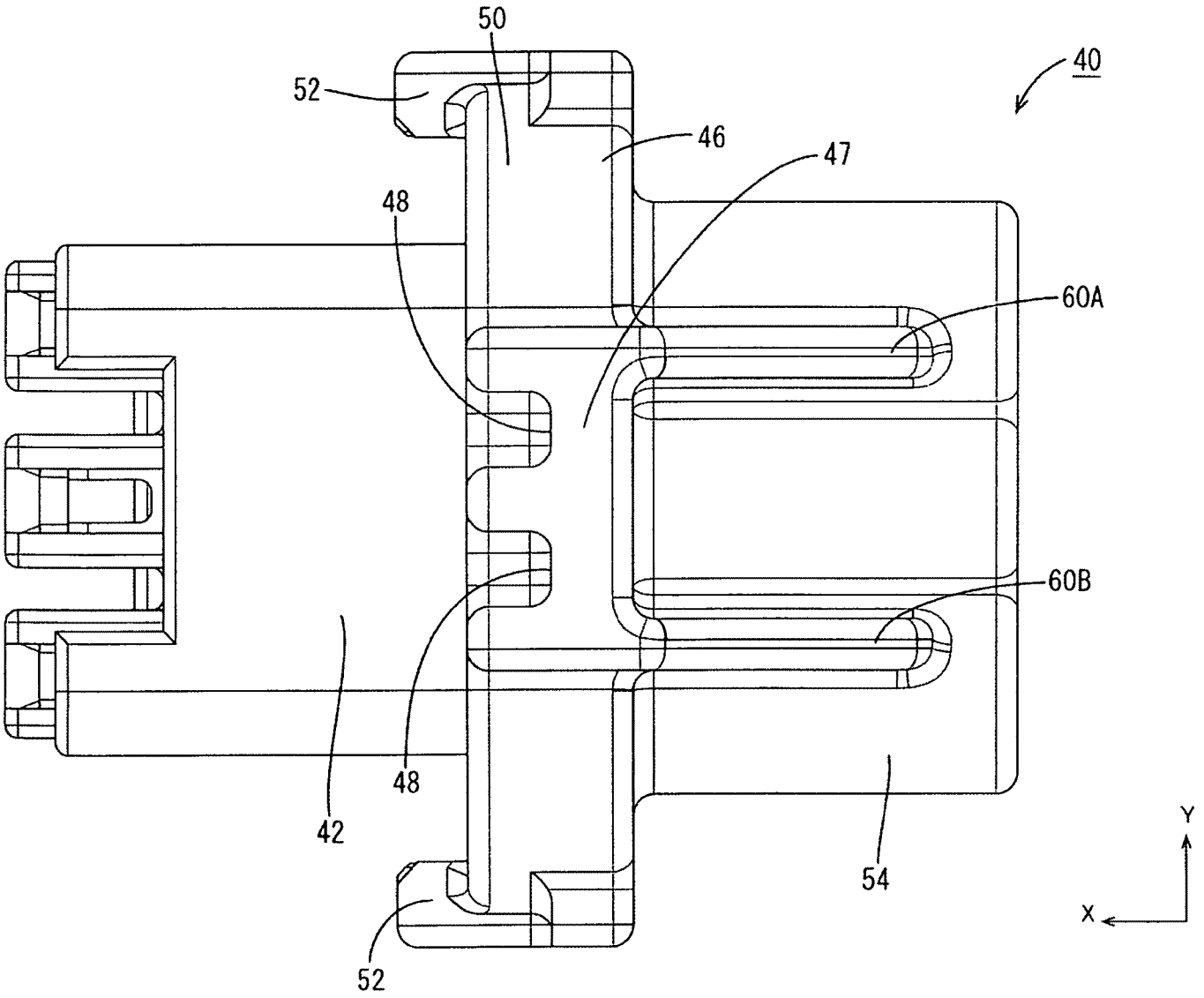
FIG. 14 is a bottom view showing the housing.

The protruding portion 46 extends in an annular manner along the outer periphery of the accommodating portion 42 (and the receptacle 13). A top part of the protruding portion 46 is divided, as shown in FIG. 1, and a lock arm 56 extends in the front-rear direction in a clearance between divided parts. The lock arm 56 restricts the separation of the connectors 10, 20 (both housings 12, 40) by having the lock protrusion 14 inserted into a lock hole 56A. A lower end part of the protruding portion 46 extending in the circumferential direction is formed with a thick portion 47 thickened on a lower surface and protruding a predetermined distance down and out, as shown in FIG. 10. The thick portion 47 is formed from a lower part of the protruding portion 46 to a lower part of the external fitting portion 50 in front of the protruding portion 46, and is formed in a region between parts of an outer peripheral edge of the protruding portion 46 where reinforcing ribs 60A, 60B are connected as shown in FIG. 13. A front part of the thick portion 47 is formed with two recesses 48 by cutting a front side to be thinned.

The external fitting 50 projects forward from the outer periphery of the protruding portion 46, and extends in an annular manner along the outer periphery of the receptacle 13. When the receptacle 13 of the mating connector 10 is fit to the external fitting 50, an inner surface 50A of the external fitting 50 faces an outer side of the tip of the receptacle 13, as shown in FIG. 3. In this way, the outer surface of the tip of the receptacle 13 is covered by the external fitting 50 and the surface of the base end side of the receptacle 13 is exposed without being covered by the external fitting 50. A tip (front end part) of the external fitting portion 50 is formed with a tapered portion 50B by having the inner surface 50A cut to extend obliquely forward. As shown in FIG. 2, the external fitting 50 is formed with fit-in portions 51 into which the left and right ridges 15B of the receptacle 13 are fit. The ridges 15A on the top are fit into clearances between the external fitting 50 and the lock arm 56. Extending pieces 52 in the form of plates extend forward from the external fitting portion 50 on both left and right end parts of the external fitting 50.

Figure 4:
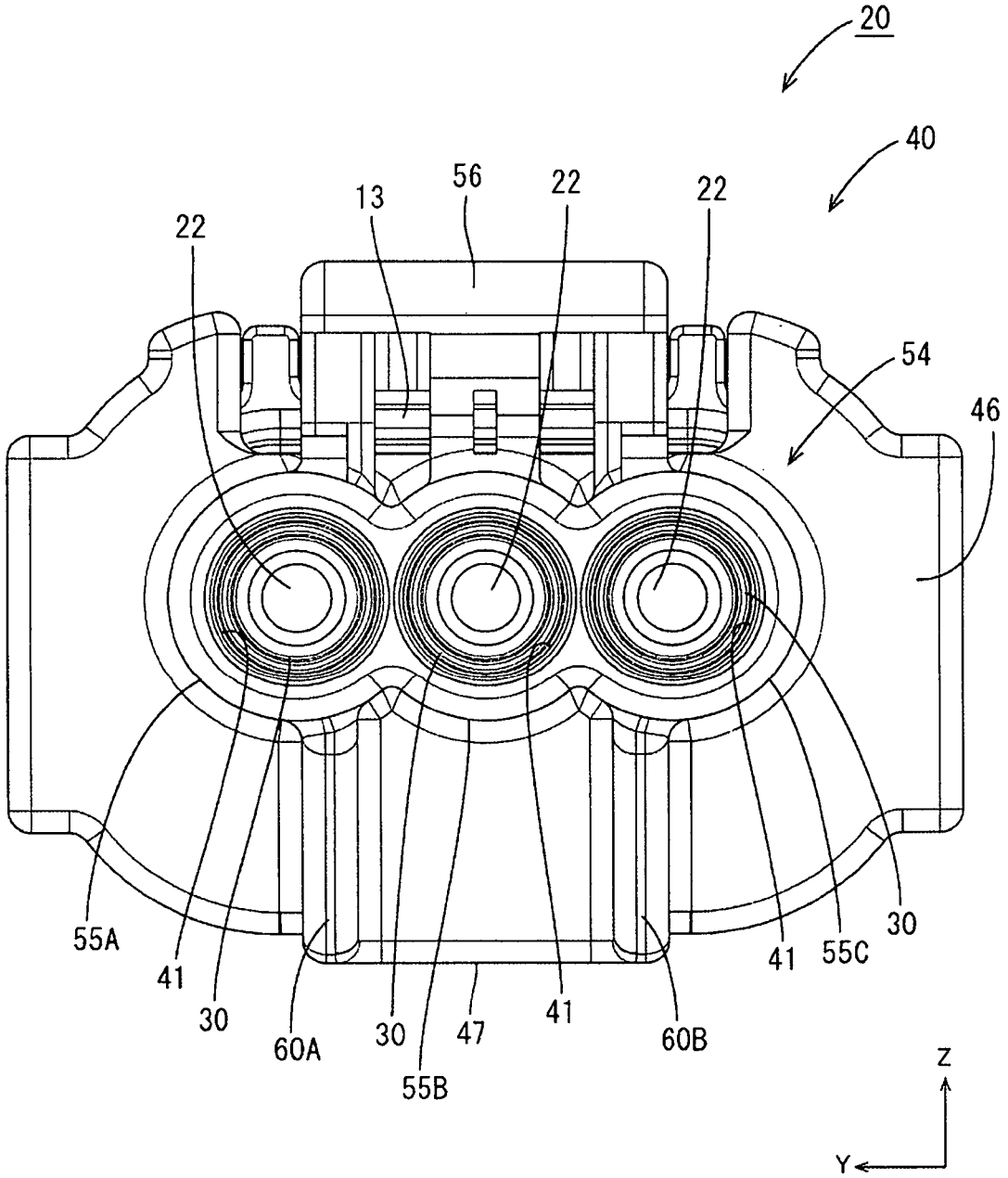
FIG. 4 is a back view showing a state where the connector is connected to the mating male connector.
Figure 5:
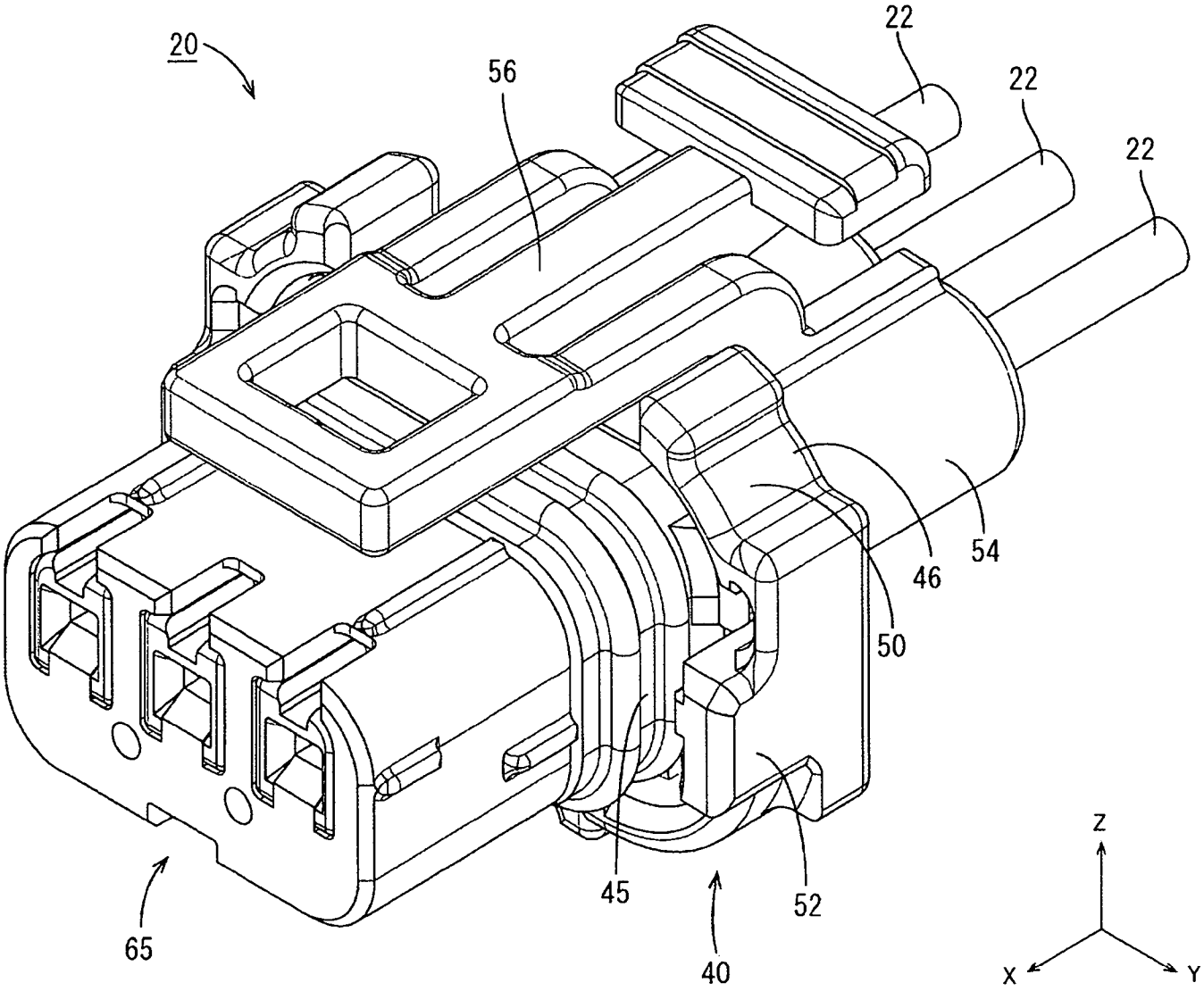
FIG. 5 is a perspective view showing the connector.
Figure 6:
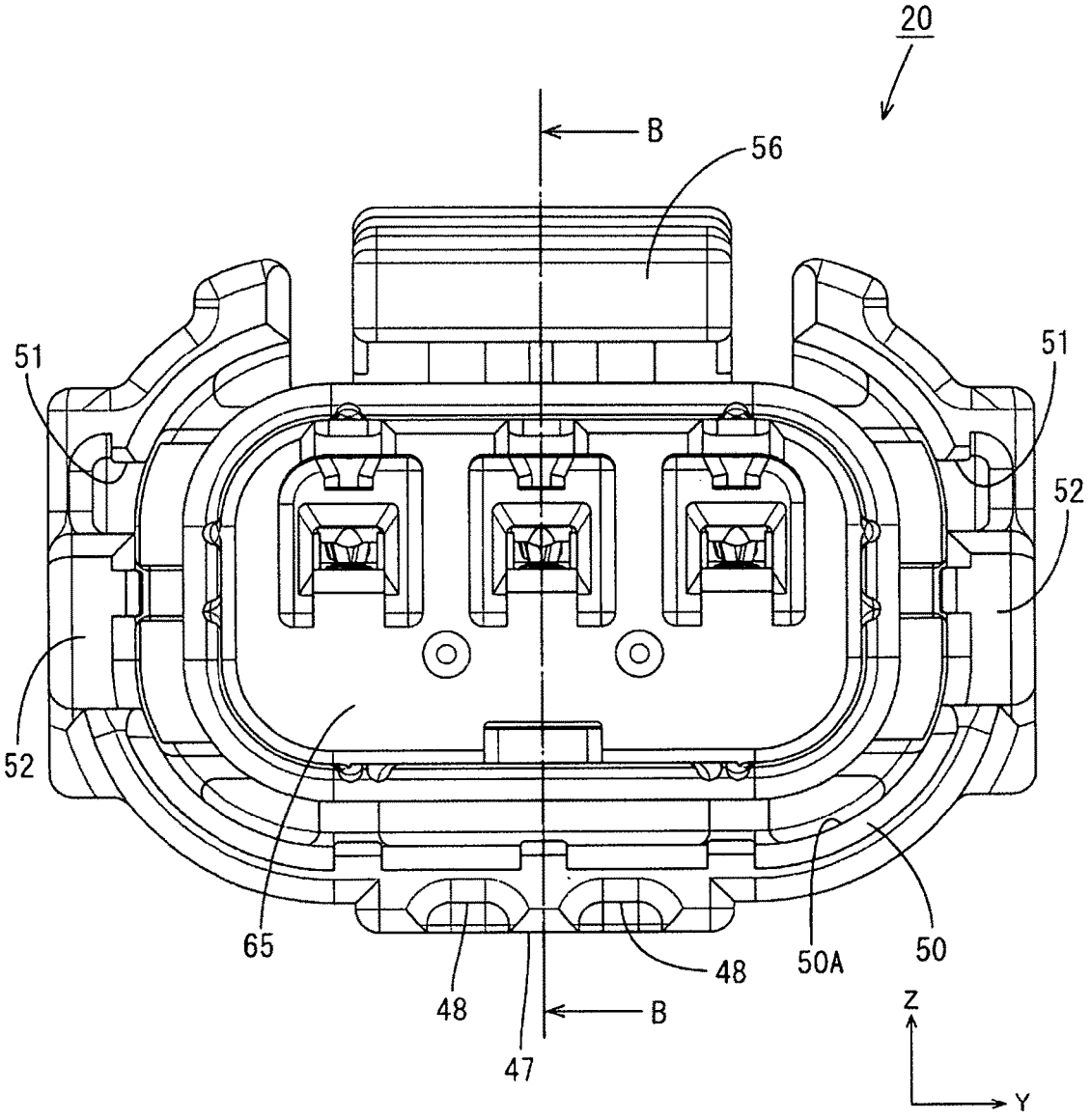
FIG. 6 is a front view showing the connector.

As shown in FIG. 4, the lead-out portion 54 has a flat shape long in the lateral direction, and openings of the three insertion holes 41 are arranged side by side in the lateral direction inside the lead-out portion 54. The rubber plug 30 having the wire 22 inserted therethrough is held in close contact with the inner wall of each insertion hole 41 of the lead-out portion 54. Three arcuate portions 55A to 55C are arranged side by side in an arcuate manner along the insertion holes 41 and are connected laterally to each other on the outer periphery of the lead-out portion 54. The lock arm 56 extends forward from the upper surface of the lead-out portion 54.

The left and right reinforcing ribs 60A, 60B are plates that are right-triangular in a side view extend parallel to each other. Parts of the reinforcing ribs 60A, 60B on the side of the lead-out portion 54 are connected integrally or unitarily to the lead-out portion 54 on sides somewhat inward of center axes of the left and right arcuate portions 55A, 55C, parts thereof on the side of the protruding portion 46 are connected integrally or unitarily to the protruding portion 46, and lower end parts thereof are connected integrally or unitarily to the thick portion 47.

The retainer 65 is made of synthetic resin and, as shown in FIG. 7, is mounted in a front side of the housing 40. The retainer 65 includes deflection restricting pieces 66 for restricting the deflection of the locking lances 44 by entering between the locking lances 44 and the inner wall of the accommodating portion 42. Further, a front end of the retainer 65 is open such that the male terminals 11 are insertable.

Figure 15:
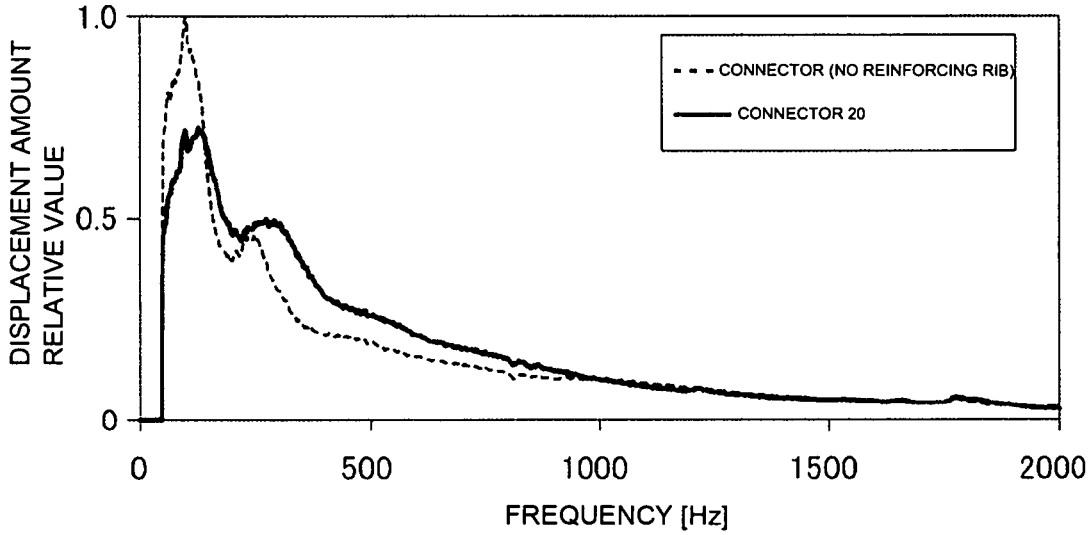
FIG. 15 is a graph showing displacement amount relative values of different female connectors when a male connector was vibrated.

FIG. 15 shows relative values of displacements of the connector 20 and another connector (unillustrated connector different from the connector 20 only in not including the reinforcing ribs 60A, 60B) when the wires 22 were vibrated when the male and female connectors were connected. Note that a maximum displacement amount of the connector not including the reinforcing ribs 60A, 60B is set at 1.0 in FIG. 15. It is understood that the connector 20 has a smaller relative value of the displacement (and a smaller maximum value of the displacement) than the connector not including the reinforcing ribs 60A, 60B. Note that since a resonant frequency of the connector 20 is set to be 2000 [Hz] or higher, vibration when the connectors resonate are not shown in FIG. 15.

Next, a manufacturing method of the connector 20 is described.

The insulation coating 24 on the end part of the wire 22 is stripped to expose the conductor 23, the exposed conductor 23 is inserted through the wire insertion hole 31 of the rubber plug 30, and the rubber plug 30 is mounted on the outer periphery of the insulation coating 24 of the wire 22. Further, the wire connecting portion 29 of the terminal 25 is crimped to the exposed conductor 23. In this way, the terminal-provided wire 21 is formed.

As the terminal-provided wire 21 is inserted into the insertion hole 41 of the housing 40, the locking lance 44 contacting the terminal 25 is deflected and deformed. When reaching a position behind the cutout 28 of the terminal 25, the locking lance 44 is restored and locked to the cutout 28. In this way, the terminal-provided wire 21 is mounted at a proper position in the insertion hole 41. The retainer 65 is mounted from the front of the housing 40 to restrict the deflection and deformation of the locking lances 44 (FIG. 7). In this way, the connector 20 is formed.

Subsequently, the male housing 12 is connected to the housing 40 from the front of the housing 40. Thus, the male terminals 11 resiliently contact the resilient contact pieces 27 of the terminals 25. Further, the lock arm 56 contacts the lock protrusion 14 of the male housing 12 and inclines. When the lock protrusion 14 reaches the lock hole 56A, the lock arm 56 is restored to be horizontal and the lock protrusion 14 is inserted into the lock hole 56A (FIG. 3). In this way, the connectors 10, 20 are connected properly to restrict separation of the connectors 10, 20.

According to this embodiment, the following functions and effects are achieved.

The connector 20 to be fit into the open receptacle 13 of the male connector 10 (mating connector) includes the terminals 25 connected to the end parts of the wires 22 and the housing 40 for holding the terminals 25. The housing 40 includes the lead-out portion 54 for leading out the wires 22 connected to the terminals 25 to outside, the protruding portion 46 protruding out to face the tip of the receptacle 13, the external fitting 50 projecting from the protruding portion 46 toward the receptacle 13 to be fit externally to the tip of the receptacle 13 and to expose the outer surface of the base end of the receptacle 13, and the reinforcing ribs 60A, 60B connected to the lead-out portion 54 and the protruding portion 46.

According to this embodiment, the external fitting 50 of the housing 40 is formed to be fit externally to the tip of the receptacle 13 and to expose the outer surface of the base end side of the receptacle 13. Thus, the connector 20 can be reduced in weight as compared to a configuration in which the external fitting 50 also is fit externally to the outer surface of the base end of the receptacle 13. The resonant frequency changes and the influence of the resonance of the connector 20 can be suppressed if the connector 20 is reduced in weight. Thus, troubles caused by vibration can be suppressed while manufacturing cost is reduced. If the connector 20 is reduced in weight, the rigidity of the housing 40 tends to be reduced and the displacement amount of the connector 20 with respect to the male connector 10 becomes larger due to the vibration of the wires 22. Thus, troubles such as sliding wear in parts of the terminals 11, 25 in contact with each other due to positional deviations of the terminals 25 and the like may occur. According to this embodiment, the protruding portion 46 and the lead-out portion 54 are connected by the reinforcing ribs 60A, 60B. Thus, the rigidity of the housing 40 is enhanced by the reinforcing ribs 60A, 60B, and troubles due to a reduction in the rigidity of the housing 40 and an increase in the displacement amount of the connector 20 can be suppressed.

Further, the terminals 25 connected to the wires 22 are provided, the lead-out portion 54 leads out the wires 22, and the reinforcing ribs 60A, 60B extend in a direction (intersecting direction) perpendicular to an arrangement direction of the wires 22. If the wires 22 vibrate, the lead-out portion 54 is vibrated more easily in the direction intersecting the arrangement direction of the wire 22 than in the arrangement direction of the wires 22. Troubles caused by vibration in such a direction as to easily cause vibration can be suppressed by the reinforcing ribs 60A, 60B.

The protruding portion 46 includes the thick portion 47 having an increased thickness, and the reinforcing ribs 60A, 60B are connected to the thick portion 47. Thus, the strength of connecting parts of the protruding portion 46 and the reinforcing ribs 60A, 60B can be enhanced by the thick portion 47 thereby suppressing troubles caused by the deformation of the housing 40.

The invention is not limited to the above described and illustrated embodiment. For example, the following modes also are included in the scope of the invention.

The shapes of the reinforcing ribs 60A, 60B are not limited to those of the above embodiment and can be changed to various shapes. For example, the thicknesses of the reinforcing ribs may be changed or the reinforcing ribs may be provided with parts separated from the protruding portion 46 and the lead-out portion 54 without being connected to the protruding portion 46 and the lead-out portion 54 over the entire lengths.

The number of the reinforcing ribs 60A, 60B is not limited to the number in the above embodiment. One, three or more reinforcing ribs may be provided.

Although the connector is a female connector, it may be a male connector.

LIST OF REFERENCE SIGNS

10: male connector (mating connector)
13: receptacle
20: connector
22: wire

25: terminal
30: rubber plug
40: housing
41: insertion hole
46: protruding portion
47: thick portion
50: external fitting
54: lead-out portion
60A, 60B: reinforcing rib

The invention claimed is:

1. A connector to be fit into an open receptacle of a mating connector, comprising:

at least one terminal connected to an end part of at least wire; and a housing for holding the at least one terminal;

the housing including:

an accommodating portion for accommodating the at least one terminal;

a lead-out portion for leading out the at least one wire connected to the at least one terminal to outside;

a protruding portion protruding outward to face a tip of the receptacle;

an external fitting projecting from the protruding portion toward the receptacle to be fit externally to the tip of the receptacle and to expose an outer surface of a base end of the receptacle by not covering the outer surface of the base end of the receptacle;

at least one reinforcing rib having a first end integrally connected to the lead-out portion and a second end integrally connected to the protruding portion; and a seal ring to be mounted on an outer periphery of the accommodating portion and held in close contact with an inner surface of the receptacle.

2. The connector of claim 1, wherein:

the at least one terminal comprises plural terminals and the at least one wire comprises plural wires, the terminals being connected respectively to the wires;

the lead-out portion leads out the wires; and the at least one reinforcing rib extends in a direction intersecting an arrangement direction of the wires.

3. The connector of claim 2, wherein:

the protruding portion includes a thick portion having an increased thickness; and the at least one reinforcing rib is connected to the thick portion.

4. The connector of claim 3, wherein the protruding portion and the external fitting extend along an outer periphery of the receptacle.

5. The connector of claim 1, wherein:

the protruding portion includes a thick portion having an increased thickness; and the at least one reinforcing rib is connected to the thick portion.

6. The connector of claim 1, wherein the protruding portion and the external fitting extend along an outer periphery of the receptacle.

* * * * *